United States Patent [19]

Harris, Jr. et al.

[11] Patent Number: 4,777,080

[45] Date of Patent: Oct. 11, 1988

[54] ELASTIC ABRASION RESISTANT LAMINATE

[75] Inventors: Robert D. Harris, Jr., Marietta; David M. Jackson, Rosewell; Michael T. Morman, Alpharetta, all of Ga.

[73] Assignee: Kimberly-Clark Corporation, Neenah, Wis.

[21] Appl. No.: 919,288

[22] Filed: Oct. 15, 1986

[51] Int. Cl.[4] ..... B32B 7/02

[52] U.S. Cl. ..... 428/212; 428/284; 428/286; 428/297; 428/298; 428/340; 428/423.1; 428/424.4; 428/903

[58] Field of Search ..... 428/212, 284, 286, 340, 428/903, 910, 423.1, 424.4, 297, 298

[56] References Cited

U.S. PATENT DOCUMENTS

| | | | |
|---|---|---|---|
| 2,957,512 | 10/1960 | Wade et al. | 154/33.05 |
| 3,016,599 | 1/1962 | Perry | 28/78 |
| 3,594,266 | 7/1971 | Okazaki | 161/173 |
| 3,673,060 | 6/1972 | Murphy et al. | 161/126 |
| 3,700,545 | 10/1972 | Matsui et al. | 161/175 |
| 3,849,241 | 11/1974 | Butin et al. | 161/169 |
| 3,932,682 | 1/1976 | Loft et al. | 428/296 |
| 3,949,128 | 4/1976 | Ostermeier | 428/152 |
| 4,100,324 | 7/1978 | Anderson et al. | 428/288 |
| 4,223,101 | 9/1980 | Fine et al. | 528/76 |
| 4,234,652 | 11/1980 | Vanomi et al. | 428/296 |
| 4,251,587 | 2/1981 | Mimura et al. | 428/233 |
| 4,296,163 | 10/1981 | Emi et al. | 428/212 |
| 4,318,408 | 3/1982 | Korpman | 128/287 |
| 4,375,446 | 3/1983 | Fujii et al. | 264/518 |
| 4,426,417 | 1/1984 | Meitner et al. | 428/195 |
| 4,426,420 | 1/1984 | Likhyani | 428/224 |
| 4,442,062 | 4/1984 | Fujii et al. | 264/518 |
| 4,555,811 | 12/1985 | Shimalla | 2/51 |

FOREIGN PATENT DOCUMENTS

| | | |
|---|---|---|
| 1575830 | 10/1980 | United Kingdom . |
| 2132939 | 7/1984 | United Kingdom . |

*Primary Examiner*—James J. Bell

*Attorney, Agent, or Firm*—Joseph P. Harps; Timothy H. Briggs

[57] ABSTRACT

An elastic laminate which includes a first elastic sheet having at least one other elastic sheet joined thereto. The first elastic sheet is formed from an ethylene vinyl acetate copolymer. The second elastic sheet is formed from a thermoplastic polyurethane elastomer. The sheets may be nonwoven webs of meltblown fibers.

24 Claims, 2 Drawing Sheets

ELASTIC ABRASION RESISTANT LAMINATE

FIELD OF THE INVENTION

The present invention falls within the field of elastic fabrics, for example, disposable elastic fabrics which may be utilized in the manufacture of wearing apparel and other items which conform about another item.

BACKGROUND OF THE INVENTION

The advent of formation of plastic materials such as plastic sheets, films and nonwoven webs by extrusion processes such as, for example, slot film extrusion, blown bubble film extrusion, meltblowing of nonwoven webs and spinbonding of nonwoven webs allowed a wide variety of products to be manufactured so inexpensively that they could be viewed as disposable after only one or a few uses. Representatives of such products include diapers, tissues, wipes and mattress pads.

Some of the problems in this area are the provision of an elastic material which is resilient and flexible while still having a pleasing hand or feel. Other characteristics which are desirable are the ability to withstand unraveling during cutting and sewing operations, good puncture resistance, wet strength and a low linting factor. A particular problem which has confronted those in the art is the provision of an elastic material which does not feel plastic or rubbery. Another problem which has confronted those in the art has been in providing a low cost elastic material which is highly resistant to abrasion and thus will have an extended life expectancy when used in applications where the material is subjected to abrasive abuse.

DEFINITIONS

The term "elastic" is used herein to mean any material which, upon application of a biasing force, is stretchable, that is, elongatable, to a stretched, biased length which is at least about 125 percent, that is about one and one quarter, of its relaxed, unbiased length, and which, will recover at least 40 percent of its elongation upon release of the stretching, elongating force. A hypothetical example which would satisfy this definition of an elastic material would be a one (1) inch sample of a material which is elongatable to at least 1.25 inches and which, upon being elongated to 1.25 inches and released, will recover to a length of not more than 1.15 inches. Many elastic materials may be stretched by much more than 25 percent of their relaxed length, for example, 100 percent or more, and many of these will recover to substantially their original relaxed length, for example, to within 105 percent of their original relaxed length, upon release of the stretching, elongating force.

As used herein, the term "nonelastic" refers to any material which does not fall within the definition of "elastic," above.

As used herein the term "recover" refers to a contraction of a stretched material upon termination of a biasing force following stretching of the material by application of the biasing force. For example, if a material having a relaxed, unbiased length of one (1) inch is elongated 50 percent by stretching to a length of one and one half (1.5) inches the material would be elongated 50 percent and would have a stretched length that is 150 percent of its relaxed length. If this exemplary stretched material contracted, that is recovered to a length of one and one tenth (1.1) inches after release of the biasing and stretching force, the material would have recovered 80 percent (0.4 inch) of its elongation.

As used herein, the term "percent set" is defined by the equation:

$$\text{percent set} = \frac{L_r - L_o}{L_o} \times 100$$

where:

$L_o$=the original relaxed length of a material; and $L_r$=the relaxed length of the material after extension.

As used herein the term "nonwoven web" means a web of material which has been formed without use of weaving processes which produce a structure of individual fibers or threads which are interwoven in an identifiable repeating manner. Nonwoven webs have been, in the past, formed by a variety of processes such as, for example, meltblowing processes, spinbonding processes, film aperturing processes and staple fiber carding processes.

As used herein the term "microfibers" means small diameter fibers having an average diameter not greater than about 100 microns, preferably having a diameter of from about 0.5 microns to about 50 microns, more preferably having an average diameter of from about 4 microns to about 40 microns.

As used herein the term "meltblown fibers" means fibers formed by extruding a molten thermoplastic material through a plurality of fine, usually circular, die capillaries as molten threads or filaments into a high velocity gas (e.g. air) stream which attenuates the filaments of molten thermoplastic material to reduce their diameter. Thereafter, the meltblown microfibers are carried by the high velocity gas stream and are deposited on a collecting surface to form a web of randomly disbursed meltblown microfibers. Such a process is disclosed, for example, in U.S. Pat. No. 3,849,241 to Butin and the disclosure of this patent is hereby incorporated by reference.

As used herein the term "sheet" means a layer which may be either a film or a nonwoven web.

As used herein the term "laminate" includes any multilayer material where the layers are joined together.

As used herein the term "palindromic" means a multilayer laminate which is substantially symmetrical. Examples of palindromic laminates would have layer configurations of A/B/A, A/B/B/A, A/A/B/B/A/A, A/B/C/B/A, etc. Examples of non-palindromic layer configurations would include A/B/C, A/B/C/A, A/B/C/D, etc.

As used herein the term "high abrasion resistance" means a material which when tested in accordance with Federal Test Method #5306 "Taber Abrader" using a CSO rubber wheel and a 125 gram counter weight will withstand at least 100 cycles without showing visible surface damage.

As used herein the term "polymer" generally includes, but is not limited to, homopolymers, copolymers, such as, for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to, isotactic, syndiotactic and random symmetries.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, plasticizers, solvents, particulates and materials added to enhance processability of the composition.

OBJECTS OF THE INVENTION

Accordingly, it is an object of the present invention to provide an elastic laminate which is elastic and has a feel suitable for use in a variety of applications.

One other object of the present invention is to provide an elastic laminate having at least one surface layer that is highly resistant to abrasion.

Another object of the present invention is to provide an elastic laminate which is elastic and has a high abrasion resistant surface and a feel suitable for use in a variety of applications with a layer of the laminate being formed from a low abrasion resistant material.

An even further object of the present invention is to provide an elastic laminate which includes a layer of low abrasion resistance meltblown ethylene vinyl acetate fibers joined to at least one layer of high abrasion resistance meltblown aromatic polyetherurethane fibers.

Still further objects and the broad scope of applicability of the present invention will become apparent to those of skill in the art from the details given hereinafter. However, it should be understood that the detailed description of the presently preferred embodiment of the present invention is given herein only by way of illustration because various changes and modifications well within the spirit and scope of the invention will become apparent to those of skill in the art in view of this detailed description.

SUMMARY OF THE INVENTION

The present invention provides an elastic laminate which includes at least two elastic sheets, each of a different elastic material. The elastic laminate includes a first elastic sheet of a first elastic material with a second elastic sheet of a second elastic material being joined to the first elastic sheet. The first elastic sheet does not possess high abrasion resistance while the second elastic sheet is highly abrasion resistant. In one embodiment the high abrasion resistant elastic sheet is gathered when the two sheets are in an untensioned configuration.

In one embodiment, the low abrasion resistance first elastic sheet is formed from an ethylene vinyl acetate copolymer having a melt index from about 32 to 500 grams per 10 minutes when measured in accordance with ASTM D-1238 at 190 degrees C. and under a 2,160 gram load. The ethylene vinyl acetate copolymer includes from about 10 percent, by weight, to about 50 percent, by weight, of vinyl acetate monomer. For example, the ethylene vinyl acetate copolymer may contain from about 18 percent, by weight, to about 36 percent, by weight, of vinyl acetate monomer. More specifically, the ethylene vinyl acetate copolymer may contain from about 26 percent, by weight, to about 30 percent, by weight, of vinyl acetate monomer.

One ethylene vinyl acetate material has about 28 percent, by weight, of vinyl acetate monomer and a melt index of about 180 grams per 10 minutes when measured in accordance with ASTM D-1238 at 190 degrees C. under a 2,160 gram load.

The ethylene vinyl acetate may be blended with at least one compatible modifying polymer. For example, a modifying polymer formed from a monomer having olefinic unsaturation. The modifying polymer may be present in amounts of up to about 90 percent, by weight, of the blend. That is, the modifying polymer may be present in an amount of from about 10 percent, by weight, to about 50 percent, by weight of the blend. For example, the modifying polymer may be present in an amount of from about 30 percent, by weight, to about 50 percent, by weight, of the blend.

Exemplary modifying polymers include polyethylene, (for example, linear low density polyethylene) polypropylene, polybutene, polystyrene and block copolymers such as A-B-A' block copolymers where A and A' are the same or different thermoplastic endblocks and B is an elastomeric poly(ethylene-butylene) midblock or $(A-B)_n$ block copolymers where A is a thermoplastic block and B is an elastomeric block and "n" is a positive integer. Compatible mixtures of two or more of these modifying polymers may also be utilized to modify the ethylene vinyl acetate copolymer.

In one embodiment, the high abrasion resistance second elastic sheet is formed from a thermoplastic elastomeric polyurethane, for example, an aromatic polyetherurethane having a melt flow of from about 30 grams per ten minutes to about 60 grams per ten minutes when measured at 190 degrees C. and with a 8,700 gram load; an elongation of from about 400 percent to about 600 percent; a modulus of elongation at 100 percent of from about 800 psi to about 1,000 psi; a modulus of elongation at 300 percent of from about 1,600 psi to about 1,800 psi; a specific gravity of from about 1.10 to about 1.3 and an abrasion resistance of from about 20 mg to about 30 mg per 1,000 cycles. The aromatic polyetherurethane has a melt index of from about 5 grams per ten minutes to about 20 grams per ten minutes when measured at 190 degrees C. under a 2,160 gram load. More particularly, the aromatic polyetherurethane has a melt index of about 13.8 grams per ten minutes when measured at 190 degrees C. and under a 2,160 gram load; an elongation of about 500 percent; a modulus of elongation at 100 percent of about 900 psi; a modulus of elongation at 300 percent of about 1,700 psi; a specific gravity of about 1.20; and an abrasion resistance of about 25 mg per 1,000 cycles.

The first and second elastic sheets are preferably elastic nonwoven webs of meltblown fibers, for example meltblown microfibers. The relaxed basis weight of the first low abrasion resistance elastic nonwoven web of meltblown fibers in the relaxed condition may vary from about 10 grams per square meter to about 150 grams per square meter. For example, the relaxed basis weight of the first elastic nonwoven web may vary from about 20 grams per square meter to about 100 grams per square meter. The relaxed basis weight of the second high abrasion resistance elastic nonwoven web of meltblown fibers in the relaxed condition may vary from about 5 grams per square meter to about 50 grams per square meter. For example, the relaxed basis weight of the second elastic nonwoven web may vary from about 10 grams per square meter to about 30 grams per square meter.

In one embodiment the laminate is a palindromic laminate which is elastic in both the machine direction and the cross machine direction and which is adapted to stretch from at least about 25 percent to about 150 percent. This laminate includes at least one inner elastic low abrasion resistance nonwoven web of meltblown ethylene vinyl acetate fibers having a relaxed basis weight of from about 40 grams per square meter to about 60 grams per square meter. The ethylene vinyl acetate fibers are formed from an ethylene vinyl acetate copolymer having about 28 percent, by weight, of vinyl acetate monomer and a melt index of about 180 grams per 10 minutes when measured in accordance with ASTM D-1238 at 190 degrees C. under a 2,160 gram load. Also included in this laminate are two outer high abrasion resistance elastic nonwoven webs of a meltblown aromatic polyetherurethane fibers each having a relaxed basis weight of from about 10 grams per square meter to about 30 grams per square meter. The aromatic polyetherurethane fibers are formed from an elastomeric aromatic polyetherurethane having a melt flow of from about 30 grams per ten minutes to about 60 grams per ten minutes when measured at 190 degrees C. and with a 8,700 gram load; an elongation of from about 400 percent to about 600 percent; a modulus of elongation at 100 percent of from about 800 psi to about 1,000 psi; a modulus of elongation at 300 percent of from about 1,600 psi to about 1,800 psi; a specific gravity of from about 1.10 to about 1.3 and an abrasion resistance of from about 20 mg to about 30 mg per 1,000 cycles.

DETAILED DESCRIPTION OF THE INVENTION

Figure 1:
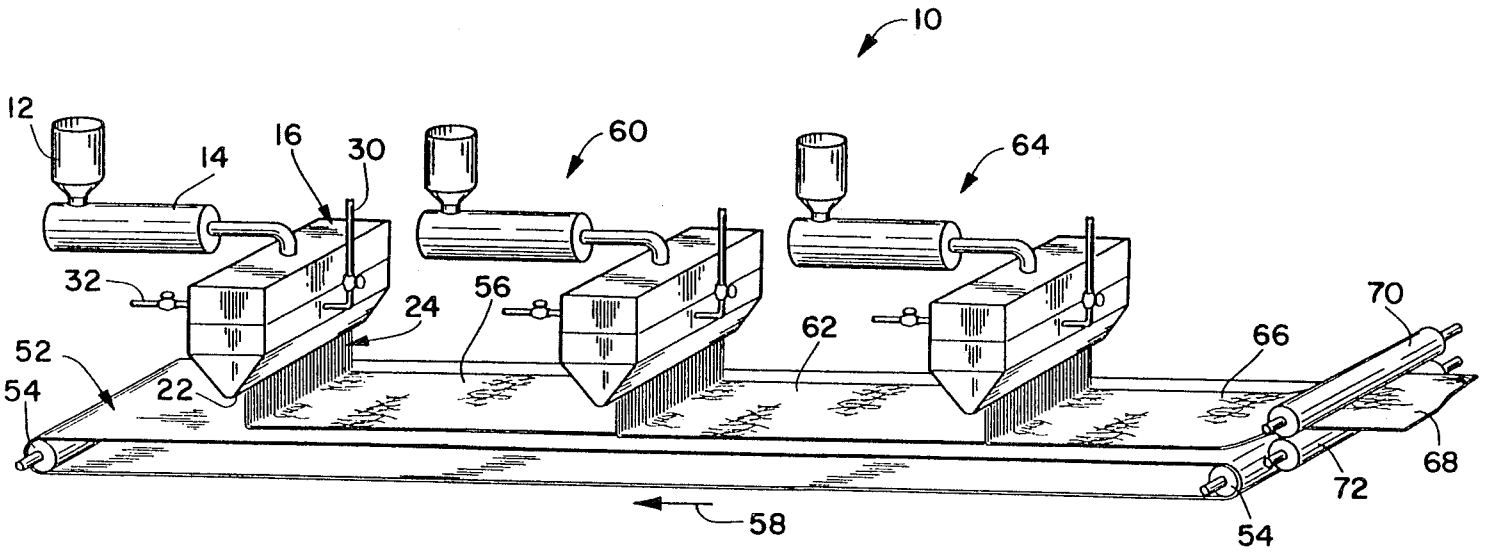
FIG. 1 is a schematic representation of a process for forming a laminate in accordance with the present invention.

Referring now to the drawings where like reference numbers represent like or equivalent structure and, in particular, to FIG. 1, there is schematically illustrated at 10 a process for forming a laminate in accordance with the present invention. In forming the elastic high abrasion resistant laminate of the present invention, pellets or chips, etc. (not shown) of a high abrasion resistant thermoplastic elastic material are introduced into a pellet hopper 12 of an extruder 14. A preferred high abrasion resistant material is a thermoplastic elastomeric polyurethane, for example, an aromatic polyetherurethane having a melt flow of from about 30 grams per ten minutes to about 60 grams per ten minutes when measured at 190 degrees C. and under a 8,700 gram load; an elongation of from about 400 percent to about 600 percent; a modulus of elongation at 100 percent of from about 800 to about 1,000 psi; a modulus of elongation at 300 percent of from about 1,600 to about 1,800 psi; a specific gravity of from about 1.10 to about 1.3 and an abrasion resistance of from about 20–30 mg per 1,000 cycles. The aromatic polyetherurethane may have a melt index of from about 5 grams per 10 minutes when measured at 190 degrees C. under a 2,160 gram load.

One aromatic polyetherurethane may be obtained from K. J. Quinn under the trade designation Q-Thane PE90. This aromatic polyetherurethane has a melt index of about 13.8 grams per ten minutes when measured at 190 degrees C. under a 2,160 gram load; an elongation of about 500 percent; a modulus of elongation at 100 percent of about 900 psi; a modulus of elongation at 300 percent of about 1,700 psi; a specific gravity of about 1.20 and an abrasion resistance of about 25 mg per 1,000 cycles.

The extruder 14 has an extrusion screw (not shown) which is driven by a conventional drive motor (not shown). As the high abrasion resistant thermoplastic elastic advances through the extruder 14, due to rotation of the extrusion screw by the drive motor, it is progressively heated to a molten state. Heating of the high abrasion resistant thermoplastic elastic to the molten state may be accomplished in a plurality of discrete steps with its temperature being gradually elevated as it advances through discrete heating zones of the extruder 14 toward a meltblowing die 16. The die 16 may be yet another heating zone where the temperature of the thermoplastic elastic is maintained at an elevated level for extrusion. The temperature which will be required to heat the high abrasion resistant thermoplastic elastic to a molten state will vary somewhat depending upon which high abrasion resistant thermoplastic elastic is utilized and can be readily determined by those in the art. However, generally speaking, the aromatic polyetherurethane may be extruded within the temperature range of from about 200 degrees Centigrade to about 250 degrees Centigrade. For example, extrusion of the aromatic polyetherurethane may be accomplished within a temperature range of from about 215 degrees Centigrade to about 245 degrees Centigrade. Heating of the various zones of the extruder 14 and the meltblowing die 16 may be achieved by any of a variety of conventional heating arrangements (not shown).

Figure 2:
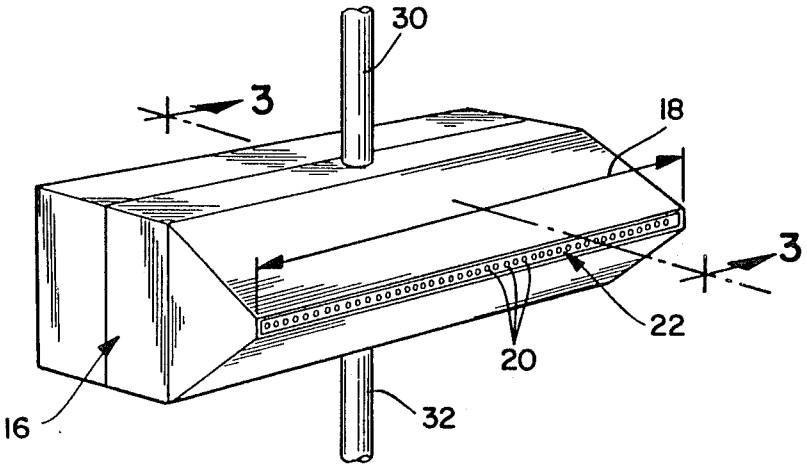
FIG. 2 is a bottom view of the die of FIG. 1 with the die having been rotated 90 degrees for clarity.

FIG. 2 illustrates that the lateral extent 18 of the die 16 is provided with a plurality of orifices 20 which are usually circular in cross-section and are linearly arranged along the extent 18 of the tip 22 of the die 16. The orifices 20 of the die 16 may have diameters that range from about 0.01 of an inch to about 0.02 of an inch and a length which may range from about 0.05 inches to about 0.20 inches. For example, the orifices may have a diameter of about 0.0145 inches and a length of about 0.113 inches. From about 5 to about 50 orifices may be provided per inch of the lateral extent 18 of the tip 22 of the die 16 with the die 16 extending from about 20 inches to about 60 inches or more. FIG. 1 illustrates that the molten high abrasion resistant thermoplastic elastic material emerges from the orifices 20 of the die 16 as molten strands or threads 24.

Figure 3:
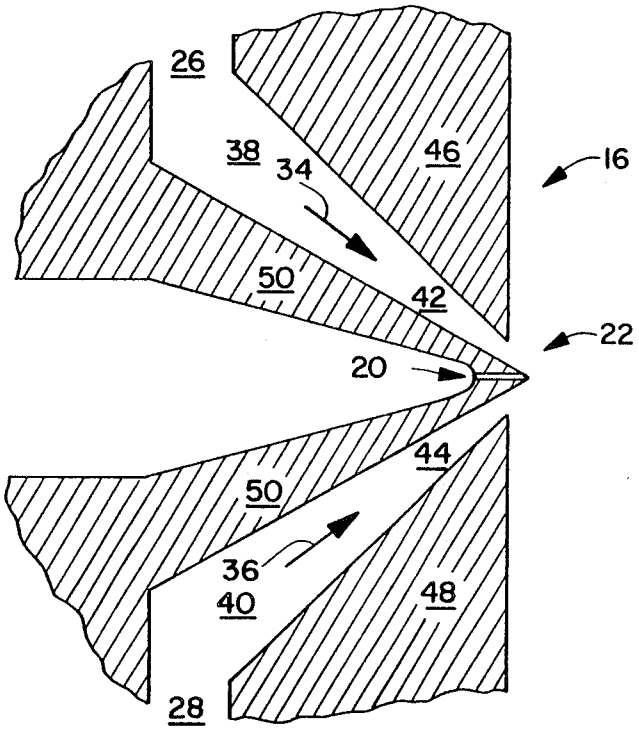
FIG. 3 is a cross-sectional view of the die of FIG. 1 taken along line 3—3 of FIG. 2.

FIG. 3, which is a cross-sectional view of the die of FIG. 2 taken along line 3—3, illustrates that the die 16 preferably includes attenuating gas inlets 26 and 28 which are provided with heated, pressurized attenuating gas (not shown) by attenuating gas sources 30 and 32. (See FIG. 1.) The heated, pressurized attenuating gas enters the die 16 at the inlets 26 and 28 and follows a path generally designated by the arrows 34 and 36 through the two chambers 38 and 40 and on through the two narrow passageways or gaps 42 and 44 so as to contact the extruded threads 24 as they exit the orifices 20 of the die 16. The chambers 38 and 40 are designed so that the heated attenuating gas passes through the chambers 38 and 40 and exits the gaps 42 and 44 to form a stream (not shown) of attenuating gas which exits the die 16 on both sides of the threads 24. The temperature and pressure of the heated stream of attenuating gas can vary widely depending on the high abrasion resistant thermoplastic elastic material utilized. However, when the aromatic polyetherurethane is utilized the heated attenuating gas can be applied at a temperature of from about 200 degrees Centigrade to about 250 degrees Centigrade, more particularly, from about 215 degrees Centigrade to about 240 degrees Centigrade. The heated attenuating gas may generally be applied at a pressure of from about 1 pound per square inch, gage to about 15 pounds per square inch, gage, for example, from about 3 pounds per square inch, gage, to about 10 pounds per square inch, gage.

The position of air plates 46 and 48 which, in conjunction with a die portion 50, define the chambers 38 and 40 and the gaps 42 and 44, may be adjusted relative to the die portion 50 to increase or decrease the width of the attenuating gas passageways 42 and 44 so that the volume of attenuating gas passing through the air passageways 42 and 44 during a given time period can be varied without varying the velocity of the attenuating gas. Furthermore, the air plates 46 and 48 may be adjusted to effect a "recessed" die-tip configuration or a positive die tip stick-out configuration as illustrated in FIG. 3. Generally speaking, a positive stick-out die-tip configuration and attenuating gas pressures of less than 10 pounds per square inch, gage are used in conjunction with air passageway widths, which are usually the same and are no greater in width than about 0.2 inches. Lower attenuating gas velocities and wider air passageway gaps are generally preferred if substantially continuous molten threads 24 are to be produced.

The two streams of attenuating gas converge to form a stream of gas which entrains and attenuates the molten threads 24, as they exit the orifices 20, into fibers or, depending upon the degree of attenuation, microfibers, of a small diameter which is less than the diameter of the orifices 20. The gas-borne fibers or microfibers 24 are blown, by the action of the attenuating gas, onto a collecting arrangement which, in the embodiment illustrated in FIG. 1, is a foraminous endless belt 52 conventionally driven by rollers 54. Other foraminous arrangements such as a rotating drum could be utilized. One or more vacuum boxes (not illustrated) may be located below the surface of the foraminous belt 52 and between the rollers 54. The fibers or microfibers 24 are collected as a coherent matrix 56 of entangled nonwoven fibers on the surface of the endless belt 52 which is rotating as indicated by the arrow 58 in FIG. 1. The vacuum boxes assist in retention of the matrix 56 on the surface of the belt 52. Typically the tip 22 of the die 16 which is forming the matrix 56 or layer of high abrasion resistant meltblown fibers is from about 5 inches to about 24 inches from the surface of the foraminous belt 52. More particularly, the tip 22 of the die 16 is located from about 6 to about 15 inches from the surface of the belt 52. This distance is preferred because it allows the meltblown fibers 24 of high abrasion resistance material to form a highly fibrous matrix 56 because as the distance of the tip 22 from the surface of the belt 52 decreases the structure and physical characteristics of the matrix 56 tend to resemble that of a film.

A second meltblowing die arrangement 60 equivalent to the first die arrangement just described is located downstream from the first die arrangement. The extruder of the second meltblowing die arrangement 60 is provided with chips or pellets, etc. of a low abrasion resistant thermoplastic elastic material. A preferred low abrasion resistant thermoplastic elastic material is an ethylene vinyl acetate copolymer having a melt index from about 32 to 500 grams per 10 minutes when measured in accordance with ASTM D-1238 at 190 degrees C. and under a 2,160 gram load. The ethylene vinyl acetate copolymer includes from about 10 percent, by weight, to about 50 percent, by weight, of vinyl acetate monomer. For example, the ethylene vinyl acetate copolymer may contain from about 18 percent, by weight, to about 36 percent, by weight, of vinyl acetate monomer. More specifically, the ethylene vinyl acetate copolymer may contain from about 26 percent, by weight, to about 30 percent, by weight, of vinyl acetate monomer.

One ethylene vinyl acetate material which may be obtained from Exxon under the trade designation Escorene LD764 (077.004) has about 28 percent, by weight, of vinyl acetate monomer and a melt index of about 180 grams per 10 minutes when measured in accordance with ASTM D-1238 at 190 degrees C. under a 2,160 gram load.

The ethylene vinyl acetate may be blended with at least one compatible modifying polymer. For example, a modifying polymer formed from a monomer having olefinic unsaturation. The modifying polymer may be present in amounts of up to about 90 percent, by weight, of the blend. That is, the modifying polymer may be present in an amount of from about 10 percent, by weight, to about 50 percent, by weight, of the blend. For example, the modifying polymer may be present in an amount of from about 30 percent, by weight, to about 50 percent, by weight, of the blend.

Exemplary modifying polymers include polyethylene, (for example, linear low density polyethylene) polypropylene, polybutene, polystyrene and block copolymers such as A-B-A′ block copolymers where A and A′ are the same or different thermoplastic endblocks and B is an elastomeric poly(ethylene-butene) midblock or $(A-B)_n$ block copolymers where A is a thermoplastic block and B is an elastomeric block and "n" is a positive integer. Compatible mixtures of two or more of these modifying polymers may also be utilized to modify the ethylene vinyl acetate copolymer.

The meltblowing die arrangement 60, in a manner substantially the same as the first die arrangement, forms a coherent matrix 62 of nonwoven fibers of the low abrasion resistant material directly on the surface of the coherent matrix of high abrasion resistant material. The temperature which will be required to heat the low abrasion resistant thermoplastic elastic material to a molten state will vary somewhat depending upon the low abrasion resistant elastic material that is utilized and can be readily determined by those of skill in the art. Generally speaking, the ethylene vinyl acetate copolymer may be extruded within the temperature range of from about 160 degrees Centigrade to about 225 degrees Centigrade, for example, from about 170 degrees Centigrade to about 210 degrees Centigrade. Additionally, when the ethylene vinyl acetate copolymer is utilized, the heated attenuating gas supplied to the die arrangement 60 may be at from about 200 degrees Centigrade to about 250 degrees Centigrade, for example, from about 210 degrees Centigrade to about 240 degrees Centigrade. The heated gas may be applied at a pressure of from about 1 pound per square inch, gage to about 5 pounds per square inch, gage. The die tip of the meltblowing die of the die arrangement 60 is adjusted to be from about 3 inches to about 20 inches from the upper surface of the coherent matrix 56 of high abrasion resistant thermoplastic elastic material. For example, the die tip of the meltblowing die arrangement 60 may be about 5 inches to about 15 inches from the surface of the matrix 56. The die tip of the meltblowing die of the die arrangement 60 may be closer to the matrix 56 than the die tip 22 of the die 16 if it is desired for the structure of the low abrasion resistant coherent matrix 62 to approach that of a film. The closer die tip arrangement also increases the likelihood that the low abrasion resistant material is still tacky when it impacts upon the matrix 56 and that the fibers of the matrix 62 are both entangled with and thermally bonded to the fibers of the matrix 56.

Preferably, the matrix 62 is a web of low abrasion resistance meltblown microfibers, having a basis weight of from about 10 grams per square meter to about 150 grams per square meter. For example, the matrix 62 may have a basis weight of from about 20 grams per square meter to about 120 grams per square meter. It is also preferable for the matrix 62 of low abrasion resistant material to have a high degree of elastic recovery. This makes it possible to use high abrasion resistance materials which have a low degree of elastic recovery while still retaining elastic properties of the laminate. A material which has a high degree of elastic recovery is one which recovers at least 75% of its extended length when extended to twice (100%) of its relaxed length, held there for one minute and then released.

Next, a third meltblowing die arrangement 64 substantially equivalent to the first and second meltblowing die arrangements forms a coherent matrix 66 of a high abrasion resistant thermoplastic elastic material directly upon the upper surface of the matrix 62. If, as is preferred, the high abrasion resistant thermoplastic material which is utilized in the third meltblowing die arrangement 64 is the same aromatic polyetherurethane as was provided to the first meltblowing die arrangement, then the process parameters described with regard to meltblowing of the coherent matrix 56 would apply to the meltblowing of the coherent matrix 66.

The composite three layer elastic material 68 may be removed from the forming belt 52 by the action of a pair of pinch rollers 70 and 72. The pinch rollers 70 and 72 may be embossed to improve the appearance of the composite elastic material 68 and/or to improve the integrity of the composite elastic material 68.

Preferably, the first and third coherent elastic matrices 56 and 66 are each a web of high abrasion resistance meltblown polyetherurethane fibers, for example, meltblown microfibers, with each web having a basis weight of from about 5 grams per square meter to about 50 grams per square meter. For example, the matrices 56 and 66 each may have a basis weight of from about 10 grams per square meter to about 30 grams per square meter.

Additional variations can be utilized in forming the composite elastic laminate of the present invention. For example, by utilizing only two meltblowing die arrangements a two layer laminate may be formed. Alternatively, more than three meltblowing die arrangements could be utilized with the first and last meltblowing die arrangement providing thin outer layers of high abrasion resistance material and the remaining meltblowing die arrangements forming a thick low abrasion resistant middle. It should also be recognized that the high abrasion resistant elastic web does not have to be formed in line as illustrated in FIG. 1. That is, the high abrasion resistant material could be formed by using only one meltblowing die arrangement and repeatedly passing the matrix (matrices) under the same die to build the composite elastic laminate one layer at a time. Yet another method which could be utilized to form the composite laminate would be to heat bond preformed nonwoven webs of high abrasion resistance and low abrasion resistance material together in a conventional manner.

The elastic laminates of the present invention which have outer polyetherurethane nonwoven webs possess a number of desirable characteristics such as, for example, high abrasion resistance, good drape and hand and multidirection elasticity.

EXAMPLE I

A composite elastic laminate having outer high abrasion resistant layers of aromatic polyetherurethane material and inner layers of low abrasion resistant ethylene vinyl acetate was formed on a four bank in-line meltblowing arrangement. The first and last meltblowing banks formed the high abrasion resistant aromatic polyetherurethane layers with the middle two banks each forming a layer of low abrasion resistant ethylene vinyl acetate material.

Meltblowing of the two outer layers of high abrasion resistant aromatic polyetherurethane material was accomplished by providing the first and fourth meltblowing die bank arrangements with an aromatic polyetherurethane obtained from the K. J. Quinn Company under the trade designation Q-Thane PE90.

Meltblowing of the aromatic polyetherurethane was accomplished by extruding the aromatic polyetherurethane through a 2½ inch diameter Johnson extruder and through a meltblowing die having 30 extrusion capillaries per lineal inch of die tip. The capillaries each had a diameter of about 0.0145 inches and a length of about 0.165 inches. The aromatic polyetherurethane was extruded through the capillaries at a rate thought to be about 0.2 grams per capillary per minute at a temperature of about 221 degrees Centigrade. The die tip configuration was adjusted so that it had a positive 0.008 inch die tip stickout from the plane of the external surface of the lips of the air plates which form the air passageways on either side of the capillaries. The air plates were adjusted so that the two air passageways, one on each side of the extrusion capillaries, formed air passageways of a width or gap of about 0.06 inches. Forming air for meltblowing the aromatic polyetherurethane was supplied to the air passageways at a temperature of about 232 degrees Centigrade and at a pressure of about 3.34 pounds per square inch, gage for the first bank and about 7.16 pounds per square inch, gage for the fourth bank. The meltblown fibers thus formed were blown onto a forming screen which was approximately 7 inches from the die tip and which was moving at a speed of about 46 feet per minute.

The two inner layers of low abrasion resistant ethylene vinyl acetate material were formed by providing the second and third meltblowing die arrangement banks with an ethylene vinyl acetate material obtained from Exxon under the trade designation Escorene LD764 (077.004).

Meltblowing (in the case of each bank) of the ethylene vinyl acetate was accomplished by extruding the ethylene vinyl acetate through a 2½ inch diameter Johnson extruder and through a meltblowing die having 30 extrusion capillaries per lineal inch of die tip. The capillaries each had a diameter of about 0.0145 inches and a length of about 0.165 inches. The ethylene vinyl acetate was extruded through the capillaries at a rate thought to be about 0.5 grams per capillary per minute at a temperature of about 177 degrees Centigrade. The die tip configuration was adjusted so that it had 0.008 inch die tip stickout from the plane of the external surface of the lips of the air plates which form the air passageways on either side of the capillaries. The air plates were adjusted so that the two air passageways, one on each side of the extrusion capillaries, formed air passageways of a width or gap of about 0.06 inches. Forming air for meltblowing the ethylene vinyl acetate was supplied to the air passageways at a temperature of about 228 degrees Centigrade and at a pressure of about 2.8 pounds per square inch, gage. The meltblown fibers thus formed were blown onto a forming screen which was approximately 7 inches from the die tip and which was moving at a speed of about 46 feet per minute.

After extrusion one layer of the aromatic polyetherurethane was removed and its melt index measured in accordance with ASTM D-1238 at 190 degrees Centigrade under a 2160 gram load. The value was found to have changed to 40.6 grams/10 minutes from 13.8 grams/10 minutes for the original resin.

The nonwoven web of meltblown fibers formed by the fourth meltblowing die bank was measured as having a basis weight of about 17 grams per square meter while the total basis weight of the laminate was measured at about 119 grams per square meter.

The laminate formed in accordance with Example 1 was tested according to the Federal Test Method Number 5306 "Taber Abrader" using a CSO rubber wheel and a 125 gram counterweight. At the end of 100 cycles there was no apparent surface damage to the laminate due to abrasion. For comparative purposes a sample of the meltblown ethylene vinyl acetate material which was utilized as the inner layer of the laminate was subjected to the same test and it was observed that after only ten cycles the ethylene vinyl acetate material was visibly physically damaged.

An Instron tensile tester was utilized to determine the machine direction peak load and the cross machine direction peak load of the laminate of Example 1. Additionally, the elongation of the laminate at peak load and the energy absorbed by the laminate at peak load was determined. In this test a three inch wide sample of the material was placed in the Instron tester which had a jaw width of three inches and a four inch jaw separation. The crosshead speed of the Instron tester was set at 20 inches per minute. The data obtained are reported in Table I with the data of Table I being an average value obtained from five replicate tests. The standard deviation of the five individual tests from the average value reported is also reported below.

TABLE I

| | MD | Std. Dev. | CD | Std. Dev. |
|---|---|---|---|---|
| Peak Load (kg) | 3.878 | 0.25 | 2.071 | 0.059 |
| Elongation at peak load (%) | 351 | 32.4 | 273 | 11.1 |
| Energy absorbed at Peak Load (Joules) | 10.18 | 1.6 | 4.10 | 0.25 |

Machine direction and cross machine direction load cycling data for the laminate of Example 1 were determined by using an Instron tester having a four inch jaw separation with three inch wide jaws. Once again, three inch wide samples were utilized and the crosshead speed of the tester was 20 inches per minute. In this test the sample was elongated fifty percent (1½ times its original length) and the load in kilograms necessary to achieve that elongation was measured. Thereafter, the sample was held in the elongated configuration for one minute, allowed to return to an unelongated configuration for one minute, and the first load cycle reading was then taken. Thereafter this cycling was repeated four times to get a value for five cycles. This data is reported in Table II below with the data representing average values that are averages of five replicate tests for the machine direction data and averages of three replicate tests for the cross machine direction.

The percentage of set in both the machine direction and cross machine direction was determined after each load cycle by measuring $L_o$ and $L_r$ and utilizing the equation defined herein.

This procedure was also conducted for cycles of 200% (3 times its original length) elongation.

TABLE II

| CYCLE # | MD LOAD (kg) | CUMULATIVE MD SET (%) | CD LOAD (kg) | CUMULATIVE CD SET (%) |
|---|---|---|---|---|
| | | 50% ELONGATION CYCLE | | |
| 1 | 2.05 | 4.60 | 1.18 | 6.00 |
| 2 | 1.69 | 5.50 | 0.98 | 7.30 |
| 3 | 1.61 | 6.30 | 0.94 | 7.80 |
| 4 | 1.56 | 7.00 | 0.91 | 8.20 |
| 5 | 1.52 | 7.40 | 0.89 | 9.30 |
| | | 200% ELONGATION CYCLE | | |
| 1 | 2.85 | 42.40 | 1.89 | 43.30 |
| 2 | 2.36 | 49.00 | 1.54 | 49.00 |
| 3 | 2.18 | 52.40 | 1.47 | 53.50 |
| 4 | 2.09 | 54.00 | 1.33 | 55.00 |
| 5 | 2.03 | 55.20 | 1.23 | 57.00 |

It is to be understood that the above disclosure of the presently preferred embodiment of the invention is to be taken as illustrative of the invention. Further, it is clear that, in view of the present disclosure, those of skill in the art should be capable of making numerous modifications without departing from the true spirit and scope of the invention. For example, different combinations of elastic webs and elastic sheets could be joined together.

What is claimed is:

1. An elastic laminate comprising:
   - a first elastic sheet comprising a low abrasion resistance material; and
   - a second elastic sheet comprising a high abrasion resistance material joined to said first elastic sheet.

2. The laminate of claim 1, wherein said first elastic sheet is an elastic matrix of meltblown fibers.

3. The laminate of claim 2, wherein the second elastic sheet is an elastic matrix of meltblown fibers.

4. An elastic laminate comprising:
   - a first nonwoven elastic matrix of a low abrasion resistance material; and
   - a second nonwoven elastic matrix of a high abrasion resistance material joined to said first nonwoven matrix.

5. The laminate of claim 4, wherein said first and second matrices each comprise meltblown fibers.

6. The laminate of claim 5, wherein the basis weight of the first elastic matrix is from about 10 grams per square meter to about 150 grams per square meter.

7. The laminate of claim 5, wherein the basis weight of the second elastic matrix is from about 5 grams per square meter to about 50 grams per square meter.

8. An elastic laminate comprising:

a first nonwoven leastic matrix comprising meltblown fibers of a low abrasion resistance ethylene vinyl acetate material; and a second nonwoven elastic matrix comprising meltblown fibers of a high abrasion resistance thermoplastic elastomeric polyurethane material joined to said first nonwoven matrix.

9. The laminate of claim 8, wherein the ethylene vinyl acetate material has about 28 percent, by weight, of vinyl acetate monomer and a melt index of from about 32 to about 500 grams per 10 minutes when measured in accordance with ASTM D-1238 at 190 degrees C. under a 2,160 gram load.

10. The elastic laminate of claim 8, wherein said high abrasion resistance material is an aromatic polyetherurethane.

11. The laminate of claim 10, wherein said thermoplastic elastomeric polyurethane is an aromatic polyetherurethane material having a melt flow of from about 30 grams per 10 minutes to about 60 grams per 10 minutes when measured at 190 degrees C. under a 8,700 gram load.

12. An elastic laminate comprising:

a first elastic matrix of meltblown ethylene vinyl acetate fibers; and a second elastic matrix of meltblown thermoplastic elastomeric polyurethane fibers joined to said first elastic matrix.

13. The elastic laminate of claim 12, wherein the basis weight of the second elastic matrix is from about 5 grams per square meter to about 50 grams per square meter.

14. The elastic laminate of claim 12, wherein said meltblown fibers are meltblown microfibers.

15. The elastic laminate of claim 12, wherein said ethylene vinyl acetate material has about 28 percent, by weight, of vinyl acetate monomer and a melt index of from about 32 to 500 grams per 10 minutes when measured in accordance with ASTM D-1238 at 190 degrees C. under a 2,160 gram load.

16. The elastic laminate of claim 12, wherein the basis weight of said first elastic matrix is from about 10 grams per square meter to about 150 grams per square meter.

17. The elastic laminate of claim 12, wherein said thermoplastic elastomeric polyurethane is an aromatic polyetherurethane materia having melt flow of from about 30 grams per 10 minutes to about 60 grams per 10 minutes when measured at 190 ° C. under a 8,700 load.

18. An elastic palindromic laminate comprising:

an inner nonwoven elastic matrix having a basis weight of from about 10 grams per square meter to about 150 grams per square meter, said inner elastic web comprising meltblown fibers formed from an ethylene vinyl acetate material having about 28 percent, by weight, of vinyl acetate monomer and a melt index of about 180 grams per 10 minutes when measured at 190 degrees C. under a 2,160 gram load; and two outer nonwoven elastic matrices each having a basis weight of from about 5 grams per square meter to about 50 grams per square meter, said outer webs comprising meltblown fibers formed from an aromatic polyetherurethane material having a melt index of about 13.8 grams per 10 minutes when measured in accordance with ASTM D-1238 at 190 degrees C. under a 2,160 gram load.

19. The palindromic laminate of claim 18, wherein the meltblown fibers of the inner web are meltblown microfibers.

20. The palindromic laminate of claim 18, wherein the meltblown fibers of the outer webs are microfibers.

21. An elastic laminate comprising:

a first elastic sheet comprising a low abrasion resistance ethylene-vinyl acetate material; and a second elastic sheet comprising a high abrasion resistance thermoplastic elastomeric polyurethane material joined to said first elastic sheet.

22. The elastic laminate of claim 21, wherein the ethylene-vinyl acetate material has about 28%, by weight, of vinyl acetate monomer and a melt index of from about 32 to about 500 grams per 10 minutes when measured in accordance with ASTM D-1238 at 190° C. under a 2,160 gram load.

23. The elastic laminate of claim 21, wherein said high abrasion resistance material is an aromatic polyetherurethane.

24. The elastic laminate of claim 22, wherein said themoplastic elastomeric polyurethane is an aromatic poluetherurethane material having a melt flow of from about 30 grams per 10 minutes to about 60 grams per 10 minutes when measured at 190 ° C. under 8,700 gram load.

* * * * *